US007922599B2

(12) United States Patent
Yamamoto

(10) Patent No.: US 7,922,599 B2
(45) Date of Patent: Apr. 12, 2011

(54) GOLF CLUB

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 12/068,940

(22) Filed: Feb. 13, 2008

(65) Prior Publication Data

US 2008/0293510 A1 Nov. 27, 2008

(30) Foreign Application Priority Data

May 21, 2007 (JP) ..... 2007-134433

(51) Int. Cl.
*A63B 53/02* (2006.01)

(52) U.S. Cl. ..... 473/288; 473/307; 473/309; 473/345

(58) Field of Classification Search ..... 473/288, 473/307, 309–311, 294–299, 345; 285/89, 285/92

See application file for complete search history.

(56) References Cited

U.S. PATENT DOCUMENTS

| | | | | |
|---|---|---|---|---|
| 4,948,132 | A * | 8/1990 | Wharton | 473/246 |
| 5,820,482 | A * | 10/1998 | Sessions | 473/305 |
| 2006/0293115 | A1 | 12/2006 | Hocknell et al. | |
| 2007/0078026 | A1 * | 4/2007 | Holt et al. | 473/305 |
| 2007/0117645 | A1 * | 5/2007 | Nakashima | 473/288 |
| 2007/0265106 | A1 * | 11/2007 | Burrows | 473/307 |
| 2008/0280693 | A1 * | 11/2008 | Chai | 473/288 |

FOREIGN PATENT DOCUMENTS

| | | | |
|---|---|---|---|
| JP | 35-14728 | | 7/1960 |
| JP | 50-84140 | U | 5/1973 |
| JP | 57-165163 | U | 10/1982 |
| JP | 61-94057 | U | 6/1986 |
| JP | 9-75483 | A | 3/1997 |
| JP | 2006-42951 | A | 2/2006 |
| JP | 2006042951 | A * | 2/2006 |

* cited by examiner

*Primary Examiner* — Stephen L. Blau
(74) *Attorney, Agent, or Firm* — Birch, Stewart, Kolasch & Birch, LLP

(57) ABSTRACT

Golf club 2 has shaft 6, head 4, inner member 8 and screw member 10. The inner member 8 has shaft channel 46 provided so as to open on the top end side, and engaging hole 52 provided separately from this shaft channel 46. The head 4 has hosel member 22 having hosel hole 26, and head hole 70 that extends from the head external surface toward inside the head. At least a part of the inner member 8 is inserted into the hosel hole 26. The shaft 6 and the shaft channel 46 are stuck by adhesion and/or fitting. Continuous hole 76 is formed with the engaging hole 52 continuous with the head hole 70, and the screw member 10 is inserted into the engaging hole 52 and the head hole 70 through this continuous hole 70. The screw member 10 is thread connected with the engaging hole 52 and/or the head hole 70.

12 Claims, 13 Drawing Sheets

22

GOLF CLUB

This application claims priority on Patent Application No. 2007-134433 filed in JAPAN on May 21, 2007. The entire contents of this Japanese Patent Application are hereby incorporated by reference.

BACKGROUND OF THE INVENTION

1. Field of the Invention

The present invention relates to a golf club.

2. Description of the Related Art

In aspects of development and sales of golf clubs, evaluations of head performance and shaft performance have been made. Methods of these evaluations involve hitting by a tester, hitting with a swing robot, and the like.

When comparison of shaft performances is intended, a head attached to this shaft is preferably of the same kind. By using the heads of the same kind, influences from the difference in the head can be minimized, whereby the shaft performance can be accurately compared. For example, when three kinds of shafts are subjected to a comparative test, the heads of the same kind are attached to the three kinds of the shafts, respectively, and then the comparative test is carried out.

However, even though the heads of the same kind are used, there exit variances of performances inevitably among these heads in a strict sense. In order to compare the shaft performance more accurately, it is preferred to conduct the test with the identical head to be sequentially attached to each shaft.

The same is applied to the comparative test of head performances. Even though the shafts of the same kind are attached to the heads, respectively, there exit variances of performances inevitably among these shafts in a strict sense. In order to compare the head performance more accurately, it is preferred to conduct the test with the identical shaft to be sequentially attached to each head.

Therefore, when the head performances and shaft performances are evaluated, it is preferred that attachment/detachment of a shaft and a head can be easily conducted.

Ease in attachment/detachment of the head and shaft can be beneficial in a variety of aspects. When the attachment/detachment can be easily conducted, golf players can easily change the shaft or the head by themselves. For example, the golf player who cannot feel satisfaction with performances of purchased golf club can easily change the shaft or the head by oneself. In addition, easy construction of an original golf club including a desired head in combination with a desired shaft is enabled by the golf players themselves. The golf players may purchase a desired head and a desired shaft, and can construct by themselves with these parts. The head and the shaft which can be easily attached/detached enable custom fabrication of a golf club.

In general, the head and the shaft are adhered with an adhesive. For separation of the adhered head and shaft, it is necessary to pull the shaft out from the shaft hole by a strong external force while allowing for thermal degradation of the adhesive by heating the joint portion at a high temperature. This operation requires efforts, equipments and time. Additionally, during the heating or pulling out, the shaft and/or the head can be damaged. Accordingly, attachment/detachment of the head and the shaft is not easy in general.

In view of the foregoing, United States Patent Application Serial No. US2006/0293115 A1 discloses a structure in which attachment/detachment of the head and the shaft is facilitated.

SUMMARY OF THE INVENTION

In the structure described in the above document, a screw is inserted from the bottom face of the sole, and the head and the shaft are stuck by this screw. The head necessitates a particular structure having a through-hole that penetrates to the sole face. The structure described in the above document is inferior in versatility since it can be applied only to heads having this particular structure with limitation. Additionally, the structure described in the above document is complicated.

An object of the present invention is to provide a golf club in which attachment/detachment of the shaft and the head is facilitated by a simple structure.

The golf club according to the present invention has a shaft, a head, an inner member and a screw member. The inner member has a shaft channel provided so as to open on the top end side, and an engaging hole provided separately from this shaft channel. The head has a hosel member having a hosel hole, and a head hole that extends from the head external surface toward inside the head. At least a part of the inner member is inserted into the hosel hole. The shaft and the shaft channel are stuck by adhesion and/or fitting. A continuous hole is formed with the engaging hole continuous with the head hole, and the screw member is inserted into the engaging hole and the head hole through this continuous hole. The screw member is thread connected with the engaging hole and/or the head hole.

Preferably, the engaging hole and the screw member are thread connected.

Preferably, the hosel member has a chipped portion extending downward from the top end face. Preferably, the inner member has an engaging protruding part engaged with the chipped portion. Preferably, engagement of the chipped portion with the engaging protruding part leads to positioning such that the engaging hole is continuous with the head hole.

Preferably, in the golf club, a control mechanism is provided which controls the penetration depth of the screw member with respect to the continuous hole.

According to the present invention, a golf club can be provided in which attachment/detachment of the shaft and the head is facilitated by a simple structure.

DESCRIPTION OF THE PREFERRED EMBODIMENTS

Hereinafter, the present invention will be explained in detail by way of preferred embodiments with appropriate reference to the accompanying drawings. Herein, terms indicating top and bottom positions/directions such as "top end", "upward", "bottom end", "downward", and the like are used. Herein, the term "top or up" means the upper side in the direction along the shaft axis line Z1, in other words, it means the shaft rear end side, or the grip side of a golf club. Further, the term "bottom or down" means the down side in the direction along the shaft axis line Z1, in other words, it means the sole side of the head. Also, unless otherwise mentioned particularly, "axis direction" herein means the direction along the shaft axis line Z1, while "circumferential direction" means the circumferential direction with respect to this axis direction, and "radial direction" means a direction that is perpendicular to the aforementioned axis direction.

Figure 1:
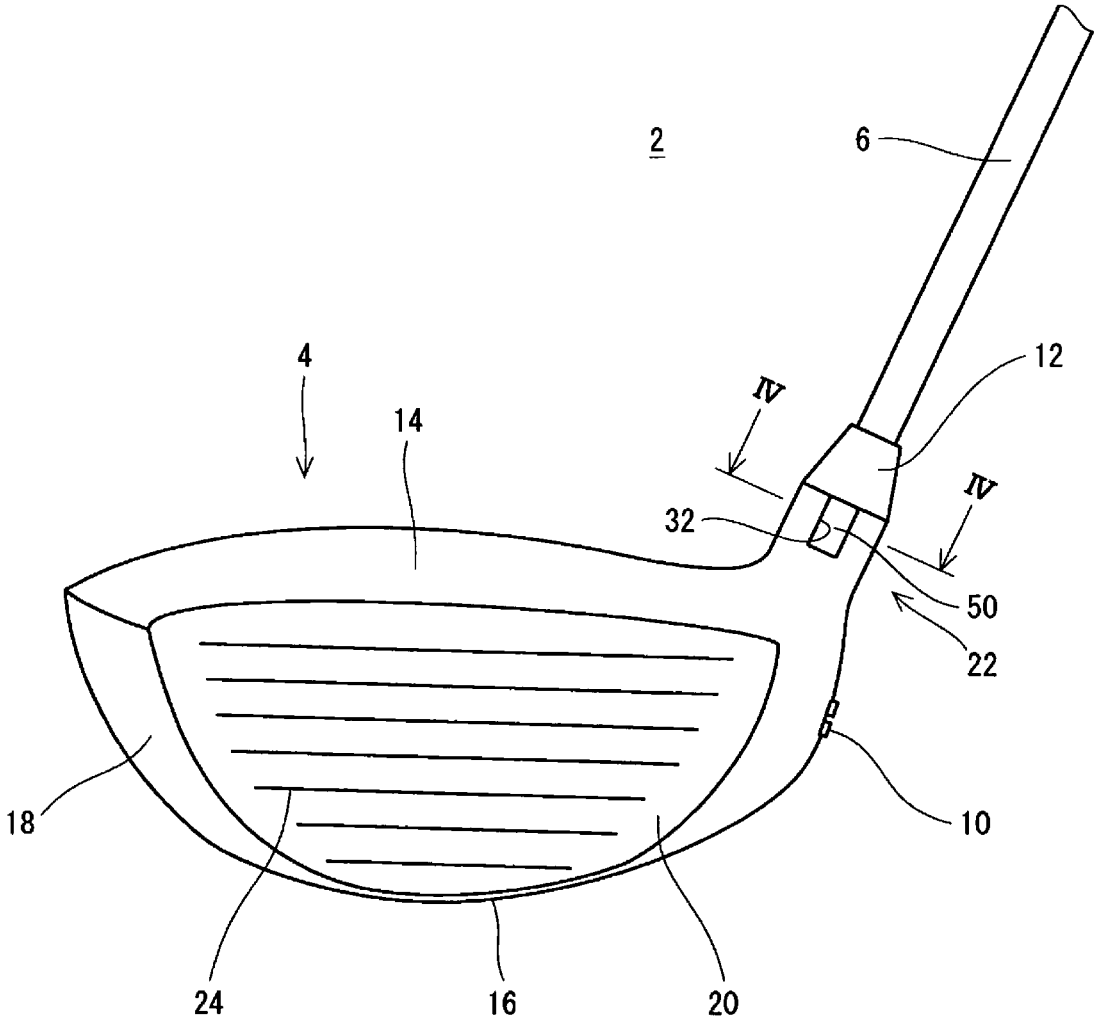
FIG. 1 shows a view illustrating a part of a golf club according one embodiment of the present invention.
Figure 2:
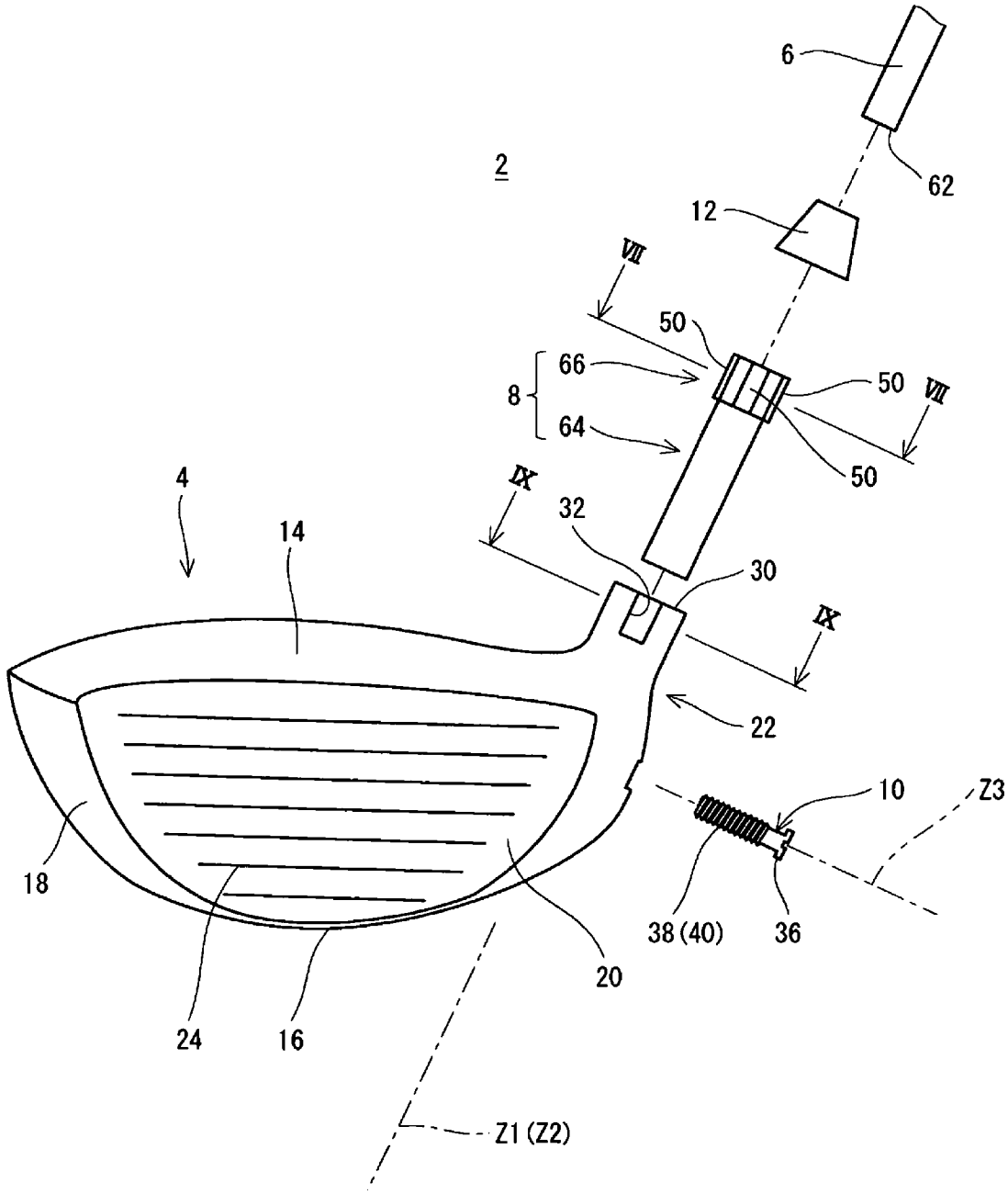
FIG. 2 shows an exploded view illustrating the golf club shown in FIG. 1.

As shown in FIG. 1 and FIG. 2, golf club 2 has head 4 and shaft 6. The head 4 is attached to one end of the shaft 6. Although not shown in the figure, a grip is attached to the other end of the shaft 6. Further, as shown in FIG. 2, the golf club 2 has inner member 8, screw member 10 and ferrule 12. The inner member 8 and the screw member 10 are members for sticking the head 4 with the shaft 6. The ferrule 12 is similar to those generally used in conventional golf clubs. The ferrule 12 may not be present.

Figure 3:
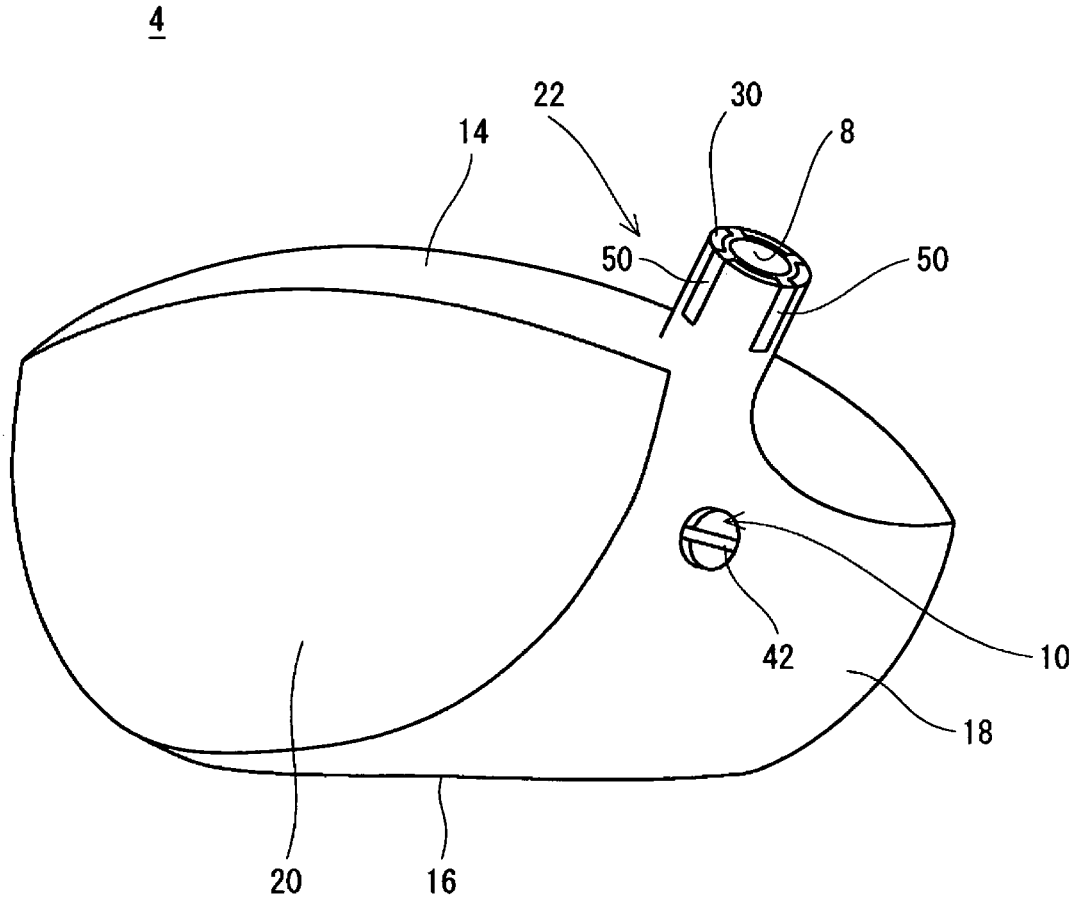
FIG. 3 shows a perspective view illustrating the golf club head in the golf club shown in FIG. 1.

FIG. 3 shows a perspective view illustrating the head 4 equipped with the inner member 8 and the screw member 10. The head 4 is a wood type golf club head. The head 4 has crown member 14, sole member 16, side member 18, face member 20 and hosel member 22. The head 4 is hollow. Face lines 24 are provide on the face member 20. In FIG. 3, depiction of the face line 24 is omitted. The head 4 may be an iron type golf club head, or any other type of head.

Figure 4:
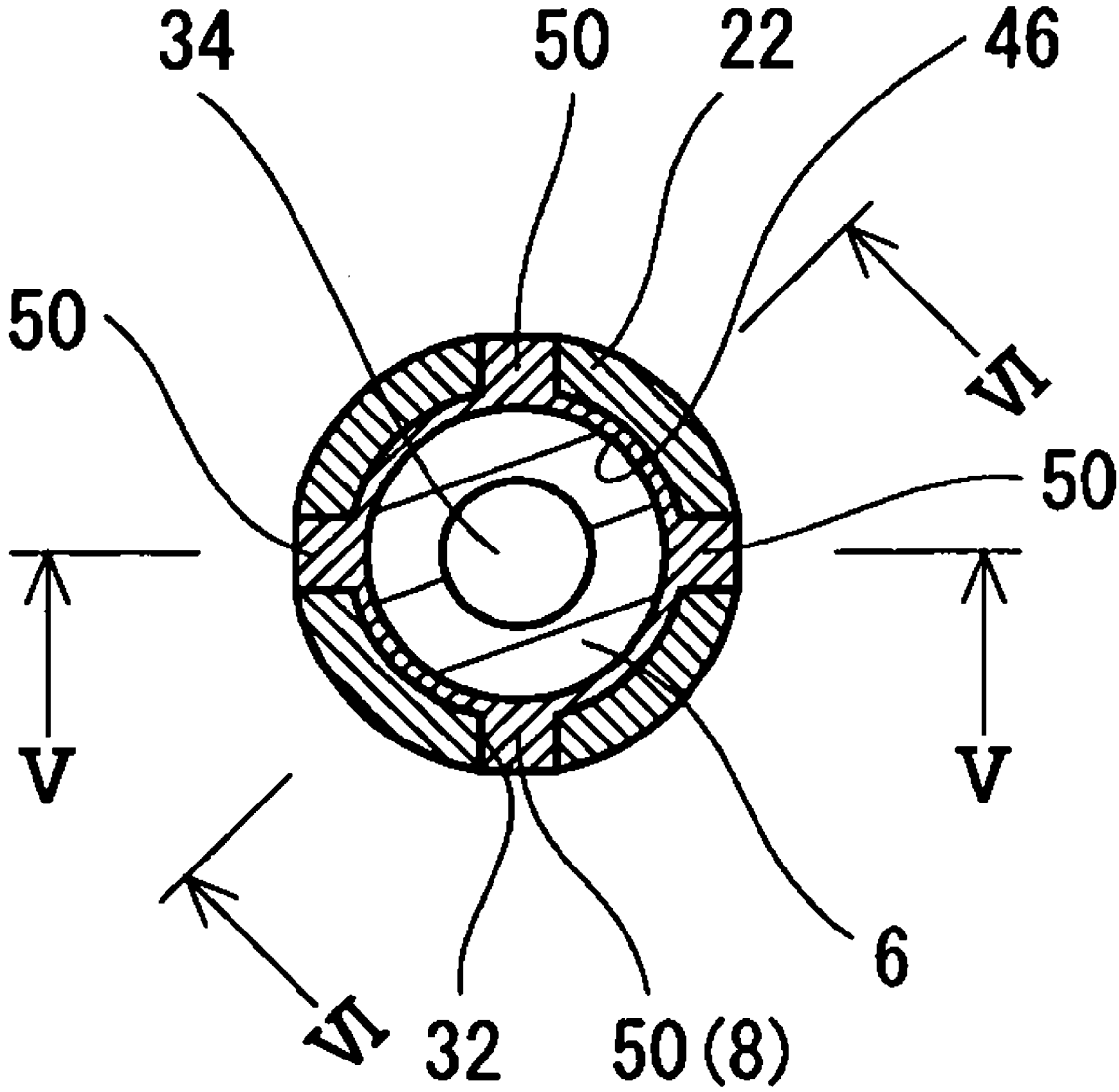
FIG. 4 shows a cross-sectional view of the golf club taken along line IV-IV in FIG. 1.
Figure 5:
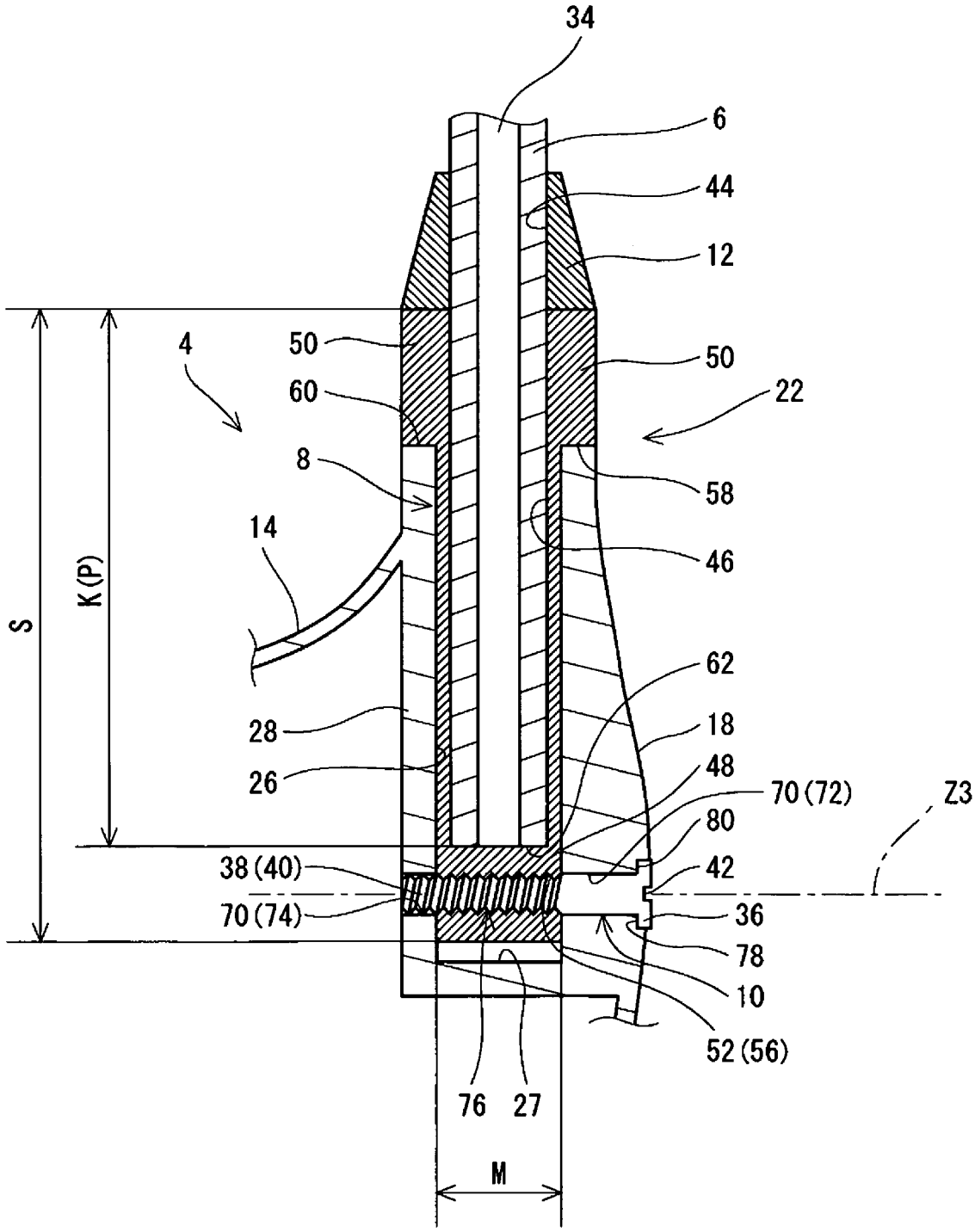
FIG. 5 shows a cross-sectional view of the golf club taken along line V-V in FIG. 4.
Figure 6:
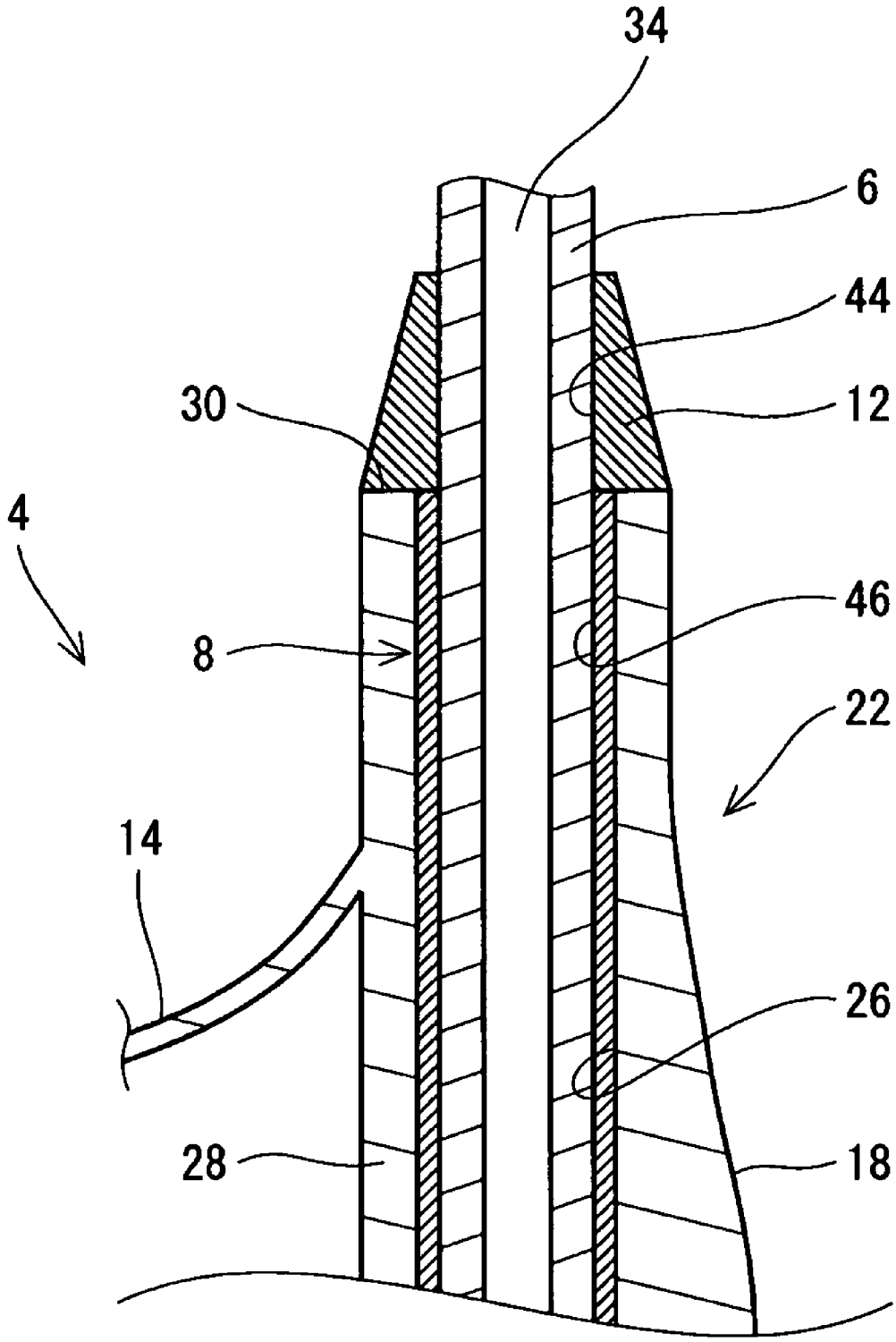
FIG. 6 shows a cross-sectional view taken along line VI-VI in FIG. 4.
Figure 7:
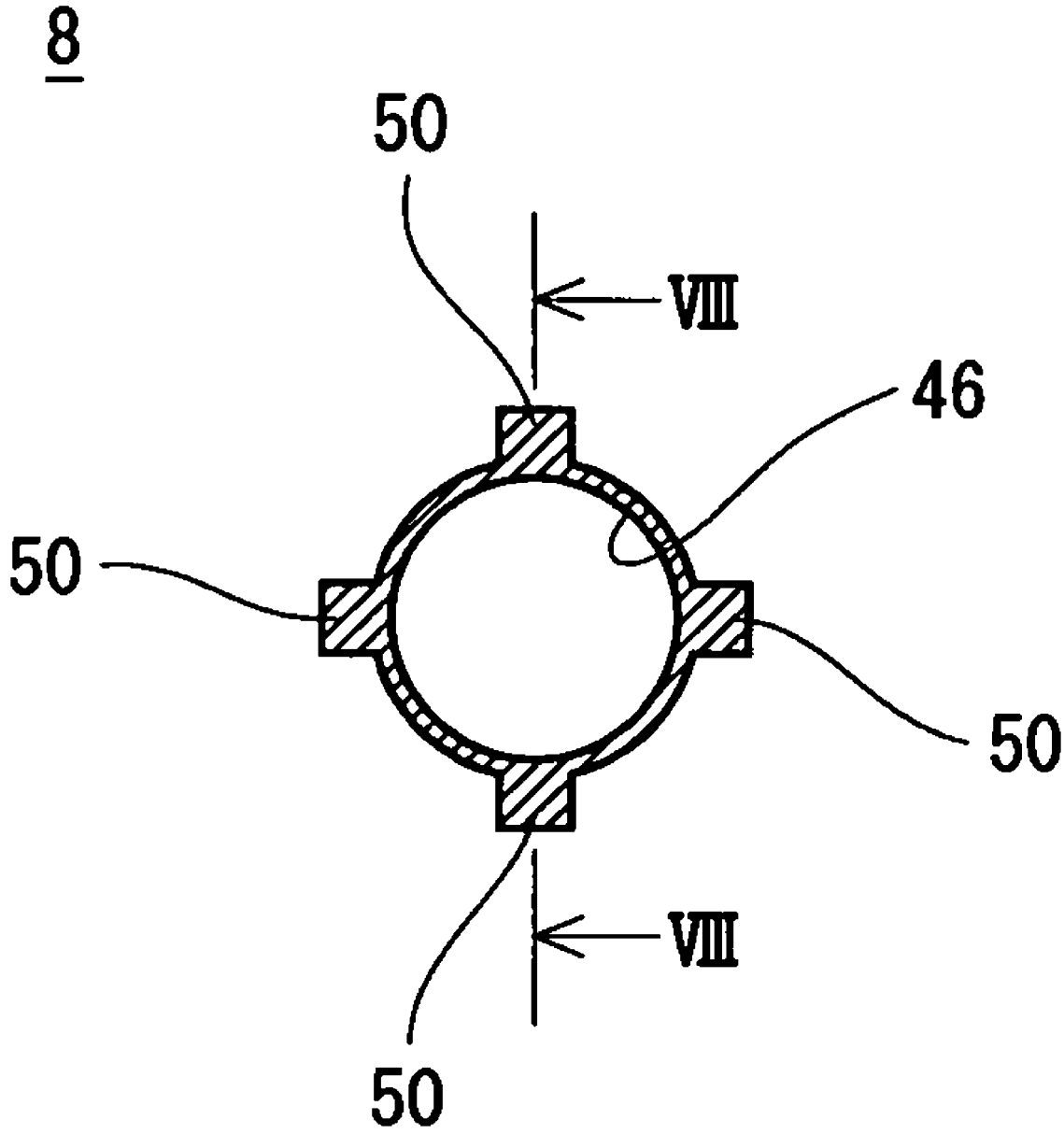
FIG. 7 shows a cross-sectional view taken along line VII-VII in FIG. 2.
Figure 8:
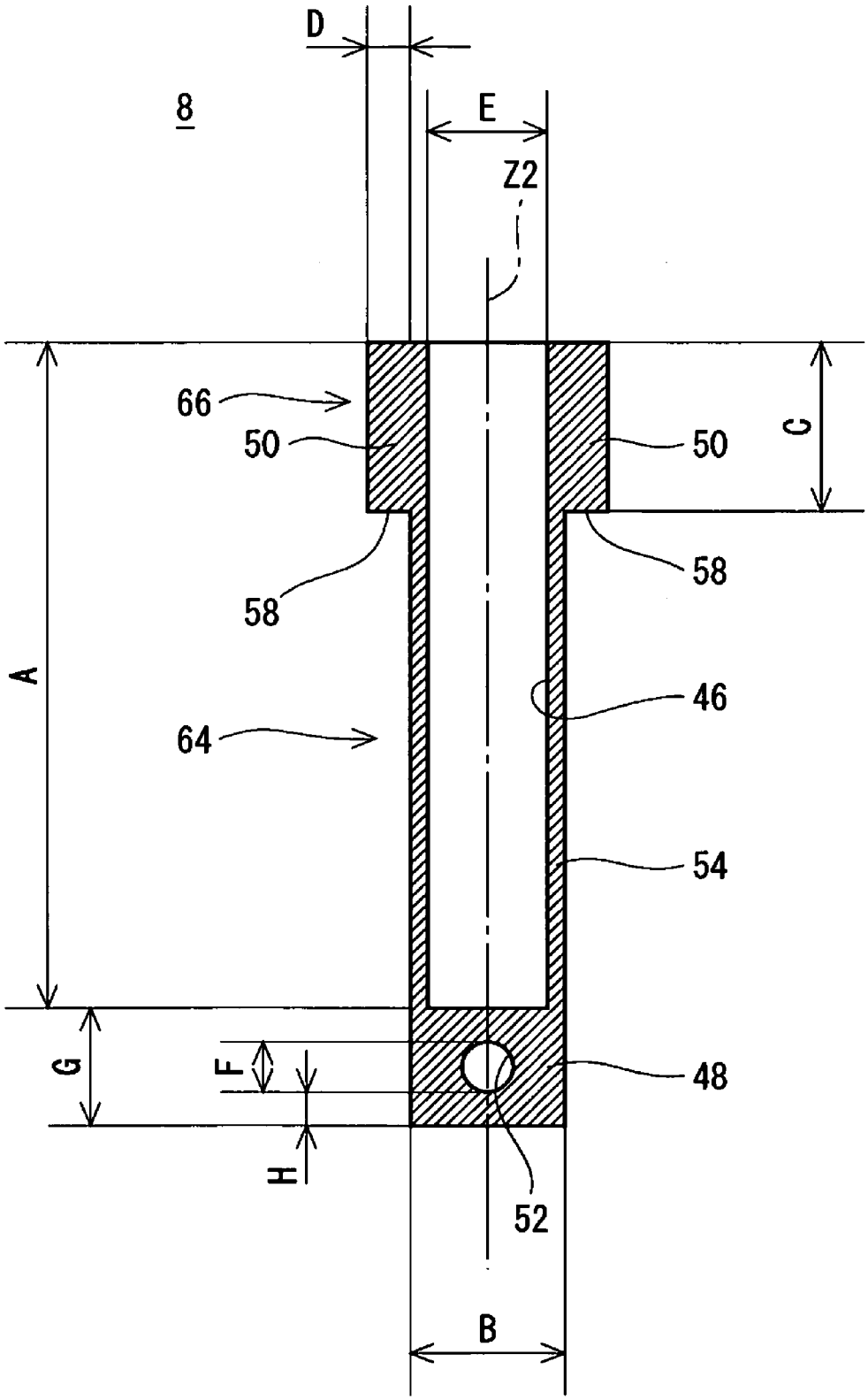
FIG. 8 shows a cross-sectional view taken along line VIII-VIII in FIG. 7.
Figure 9:
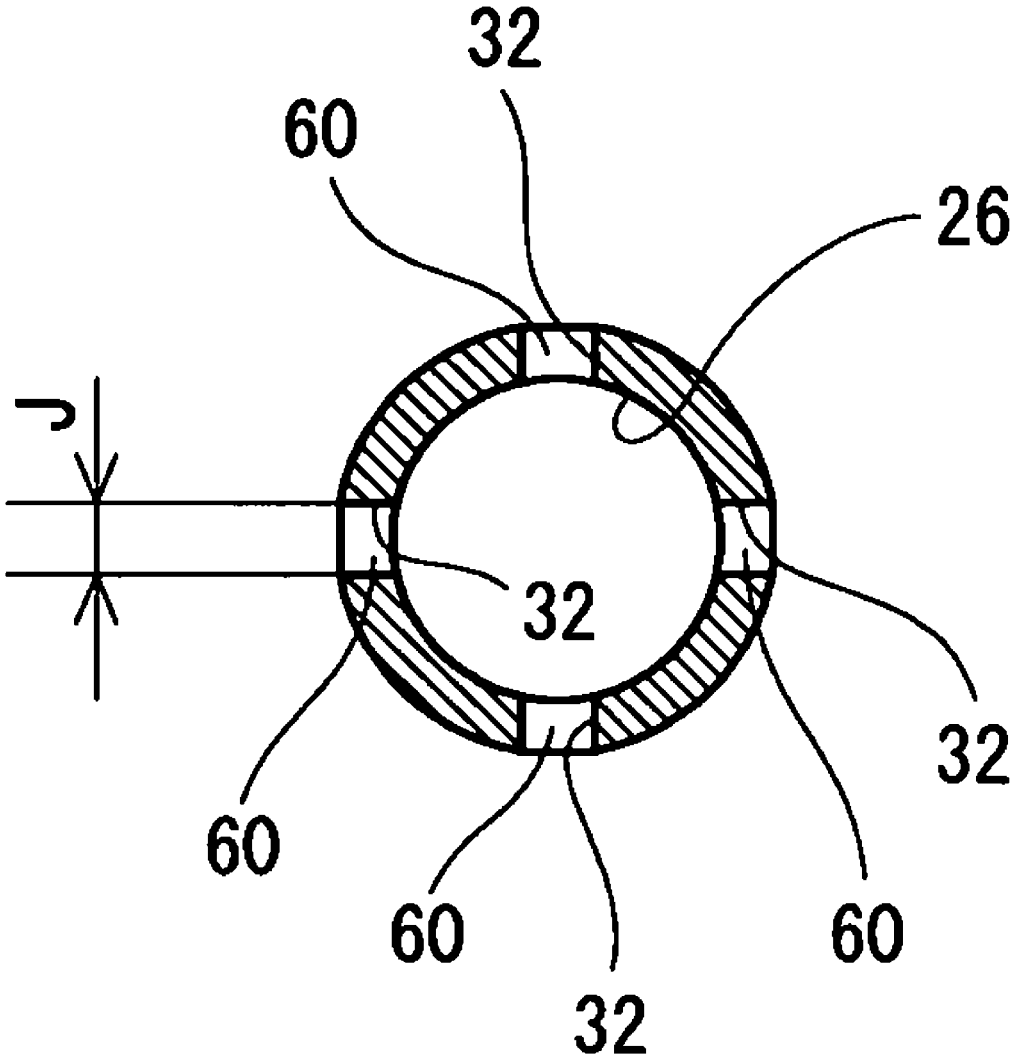
FIG. 9 shows a cross-sectional view taken along line IX-IX in FIG. 2.

FIG. 4 shows a cross-sectional view taken along line IV-IV in FIG. 1; FIG. 5 shows a cross-sectional view taken along line V-V in FIG. 4; FIG. 6 shows a cross-sectional view taken along line VI-VI in FIG. 4. FIG. 7 shows a cross-sectional view taken along line VII-VII in FIG. 2. FIG. 7 shows a cross-sectional view of the inner member 8 alone. FIG. 8 shows a cross-sectional view taken along line VIII-VIII in FIG. 7. FIG. 8 shows a cross-sectional view of the inner member 8 alone. FIG. 9 shows a cross-sectional view taken along line IX-IX in FIG. 2. The cross section shown in FIG. 5 is in orthogonal relationship to one another with the cross section shown in FIG. 8.

The hosel member 22 has hosel hole 26. The hosel hole 26 is open upward. The hosel hole 26 extends straight to the bottom face 27. The cross-sectional shape of the inner peripheral face of the hosel hole 26 is circular. The hosel hole 26 extends downward in the direction along the shaft axis line Z1. Inside the head 4, there is provided a hole forming part 28 for forming the hosel hole 26.

As shown in FIG. 2, the hosel member 22 has chipped portion 32 that extends downward from the top end face 30 thereof. The chipped portion 32 constitutes a space. As shown in FIG. 9, the chipped portion 32 is provided to be equally spaced in the circumferential direction of the hosel member 22. The chipped portion 32 is provided every 90° in the circumferential direction of the hosel member 22. The chipped portion 32 is provided at four sites.

The chipped portion 32 extends parallel to the shaft axis line Z1. The width of the chipped portion 32 is even. In other words, the width of the chipped portion 32 (width in the circumferential direction) is identical at every location in the direction along the shaft axis line Z1.

As shown in FIG. 4 and FIG. 5, the shaft 6 is tubular, and has an apparently circular cylindrical shape. The shaft 6 includes a hollow part 34 therein. This hollow part 34 is open downwards. This hollow part 34 passes through the shaft 6.

The screw member 10 has a substantially circular cylindrical shape. As shown in FIG. 1 and FIG. 5, the screw member 10 has head part 36 and body part 38. The external diameter of the head part 36 is greater than the external diameter of the body part 38. Threaded part is provided on the outer peripheral face of the screw member 10. Threaded part 40 is provided on the body part 38. The threaded part 40 is male threaded. As shown in FIG. 3, groove 42 is provided on the end face of the head part 36. This groove 42 facilitates rotation of the screw member 10. Engagement of a slotted screwdriver or the like with the groove 42 can facilitate screwing and detachment of the screw member 10.

The ferrule 12 is a generally used product. The ferrule 12 is constituted with cellulose acetate or the like. The ferrule 12 has an insertion hole 44. The shaft 6 is inserted into the insertion hole 44. The outer peripheral face of the ferrule 12 is tapered. The bottom end face of the ferrule 12 abuts the top end face 30 of the hosel member. The external diameter of the ferrule 12 at the bottom end face is approximately equal to the external diameter of the hosel member at the top end face 30.

As shown in FIG. 7 and FIG. 8, the inner member 8 has shaft channel 46, bottom member 48, and engaging protruding part 50. Furthermore, as shown in FIG. 8, the inner member 8 has engaging hole 52. In the inner member 8, the shaft channel 46 is open upwards. The shaft channel 46 extends from the top end face of the inner member 8 to the bottom member 48. The inner member 8 is integrated as a whole. The integrated inner member 8 has a high strength.

As shown in FIG. 5 and FIG. 6, the shaft 6 is inserted into the shaft channel 46. The shaft channel 46 and the shaft 6 are stuck by adhesion. In other words, the inner peripheral face of the shaft channel 46 is adhered to the outer peripheral face of the shaft 6. An adhesive is used for the adhesion. Alternatively, the shaft channel 46 and the shaft 6 may be stuck by fitting. The adhesion with an adhesive may be employed in combination with fitting.

The engaging hole 52 passes through the inner member 8. The engaging hole 52 passes through the bottom member 48 of the inner member 8. The axis line Z2 of the shaft channel 46 (see, FIG. 8), and the axis line Z3 of the engaging hole 52 (see, FIG. 5) are orthogonal one another. The axis line Z2 of the shaft channel 46 is common to the shaft axis line Z1.

In this embodiment, the engaging hole 52 passes through the bottom member 48 having a cylindrical shape. The length of the engaging hole 52 along the axis line Z3 is identical with the external diameter of the cylindrical part of the inner member 8. Also, the engaging hole 52 may be a hole that passes through the lateral wall 54 that is present on the external side in the axial direction of the shaft channel 46. However, in this case, the engaging area of the inner member 8 with the screw member 10 is liable to be small. Furthermore, in this instance, the strength of the inner member 8 is liable to be decreased. In view of ensuring the engagement of the screw member 10, it is preferred that the engaging hole 52 is formed so as to penetrate the bottom member 48 provided below the shaft channel 46. In this embodiment, this bottom member 48 is solid except for the engaging hole 52. The solid bottom member 48 leads to increase in the thickness of the inner member 8 around the engaging hole 52, whereby the strength of the inner member 8 can be even more enhanced.

As shown in FIG. 5, threaded part 56 is provided in the engaging hole 52. The threaded part 56 is female threaded. The threaded part 56 of the engaging hole 52 is thread connected with the threaded part 40 of the screw member 10. This thread connection ensures the engagement of the inner member 8 with the screw member 10.

As shown in FIG. 1, the inner member 8 is not visually recognized from the outside of the golf club 2. The inner member 8 is masked by the head 4. To the contrary, as shown in FIG. 3, the end face of the head part 36 of the screw member 10 is exposed.

At least a part of the inner member 8 is inserted into the hosel hole 26. In this embodiment, whole of the inner member 8 is inserted into the hosel hole 26. The insertion into the hosel hole 26 allows the inner member 8 to be held by the hosel hole 26. The inner member 8 and the hosel hole 26 are not adhered.

The tip part of the shaft 6 is inserted into the shaft channel 46, and thus located inside the hosel hole 26. In other words, the shaft 6 has a part positioned inside the hosel hole 26 while being inserted into the shaft channel 46. According to this construction, the shaft 6 is held by the shaft channel 46, and is concomitantly supported also by the hosel hole 26. This construction allows the stress that acts on the tip part of the shaft 6 to be received by the hosel hole 26. Therefore, deformation of the shaft channel 46 and the shaft 6 can be inhibited. As a result, the sticking of the shaft 6 with the shaft channel 46 becomes likely to be kept, and the inner member 8 becomes resistant to the removal from the hosel hole 26.

As described above, the inner member 8 has engaging protruding part 50. As shown in FIG. 8, the engaging protruding part 50 is provided at the top end part of the inner member 8. The engaging protruding part 50 is provided on the external surface of the inner member 8. As shown in FIG. 7, the engaging protruding part 50 is protruded outwards in the radial direction. As shown in FIG. 4, the engaging protruding part 50 is positioned at the chipped portion 32. The engaging protruding part 50 is inserted into the chipped portion 32. The engaging protruding part 50 is engaged with the chipped portion 32. The shape of the engaging protruding part 50 corresponds to that of the shape of the chipped portion 32. The positioning of the engaging protruding part 50 corresponds to the chipped portion 32. Similarly to the chipped portion 32, the engaging protruding part 50 is positioned to be equally spaced in the circumferential direction. The engagement of the engaging protruding part 50 with the chipped portion 32 controls relative rotation (relative rotation in the circumferential direction) of the inner member 8 and the hosel member 22 of the head 4. In light of suppression of the relative rotation of the hosel member 22 and the inner member 8, the engaging protruding part 50 may be preferably fitted with the chipped portion 32. In light of suppression of the relative rotation of the hosel member 22 and the inner member 8, the engaging protruding part 50 and the chipped portion 32 are fitted such that there exists no gap in the circumferential direction. At least one engaging protruding part 50 may be present. Also, at least one chipped portion 32 may be present.

The chipped portion 32 and the engaging protruding part 50 also play a role as a stopper that controls the insertion length S of the inner member 8 with respect to the hosel hole 26 (see, FIG. 5). More specifically, engagement of the bottom end 58 of the engaging protruding part 50 with the bottom end 60 of the chipped portion 32 (see, FIG. 5) controls the insertion length S of the inner member 8.

As shown in FIG. 5, the end face 62 of the bottom end of the shaft 6 abuts the bottom member 48 of the inner member 8. This abutment can maximize the insertion length of the shaft 6 with respect to the shaft channel 46, whereby the contact area of the inner member 8 with the shaft 6 can be enlarged. Accordingly, sticking of the shaft 6 with the inner member 8 can be even more ensured. Alternatively, the end face 62 may not abut the bottom member 48.

As shown in FIG. 2 and FIG. 8, the inner member 8 has circumference face part 64 and engaging part 66. The circumference face part 64 corresponds to a part the external surface of which is a circumference face. The engaging part 66 is a part where the engaging protruding part 50 is arranged on the external surface. The boundary between the circumference face part 64 and the engaging part 66 corresponds to the bottom end 58 of the engaging protruding part 50. The engaging part 66 is positioned upside the circumference face part 64.

As shown in FIG. 5, the head 4 has head hole 70. The head hole 70 has external head hole 72 provided on more external surface side of the head than the hosel hole 26, and inner head hole 74 provided more inside the head than the hosel hole 26. The external head hole 72 runs from the external surface of the head 4 reaching to the hosel hole 26. The inner head hole 74 runs from the inner peripheral face of the hosel hole 26 reaching to the hollow part of the head 4. The inner head hole 74 penetrates the hole forming part 28 of the head 4. The external head hole 72 and the inner head hole 74 are coaxially arranged. In other words, the central axis of the external head hole 72 is in common with the central axis of the inner head hole 74. The head hole 70 is divided into the external head hole 72 and the inner head hole 74 by the hosel hole 26.

The head hole 70 and the engaging hole 52 of the inner member 8 form single hole that is continuous with one another. Continuous hole 76 is formed by the engaging hole 52 and the head hole 70 continuous therewith. The axis line of the engaging hole 52 is in common with the axis line of the head hole 70. The external head hole 72, the engaging hole 52, and the inner head hole 74 form the continuous hole 76. The screw member 10 is inserted into this continuous hole 76. The screw member 10 is inserted into the external head hole 72, the engaging hole 52 and the inner head hole 74. The continuous hole 76 is open outward. The continuous hole 76 is open to the side member 18 of the head 4. The screw member 10 can be screwed from this opening.

A threaded part is formed on the inner peripheral face of the engaging hole 52. The threaded part of this engaging hole 52 is female threaded. Any threaded part is not formed on the inner peripheral face of the head hole 70. In other words, no threaded part is formed on the inner peripheral face of the external head hole 72, and no threaded part is formed on the inner peripheral face of the inner head hole 74.

The screw member 10 is thread connected with the engaging hole 52. More specifically, female screw of the engaging hole 52 and the threaded part 40 (male screw) of the screw member 10 are thread connected. The head hole 70 is not thread connected with the screw member 10. More specifically, the external head hole 72 and the screw member 10 are not thread connected, and the inner head hole 74 and the screw member 10 are not thread connected.

Accordingly, at least a part of the continuous hole 76 and the screw member 10 are thread connected. In this embodiment, the engaging hole 52 is thread connected with the screw member 10. This thread connection allows for rigid engagement of the inner member 8 with the screw member 10. Further, the screw member 10 is also engaged with the head hole 70. In other words, the screw member 10 is engaged with the head hole 70 by insertion into the external head hole 72 and the inner head hole 74. Therefore, the inner member 8 and the head 4 are surely engaged by the screw member 10. This engagement prevents removal of the inner member 8 from the hosel hole 26.

In the cross-sectional view shown in FIG. 5, there is no space between the external surface of the head (external surface of the side member 18) and the hosel hole 26. In other words, the head is solid between the external surface of the head, and the hosel hole 26. There exists no hollow part of the head 4 between the external surface of the head, and the hosel hole 26.

The axial force can be generated by fastening of the thread connection. This axial force is a force that acts in the axis line direction of the screw member. When the hosel member 22 is deformed by this axial force, the axis line direction of the hosel hole 26 can be altered. The alteration of the axis line direction of the hosel hole 26 is not preferred because the direction of the shaft axis line Z1 is also altered, whereby the lie angle and the real loft angle of the head are altered. In addition, when the hosel hole 26 is curved through deformation of the hosel member 22, insertion of the inner member 8 into the hosel hole 26 can be difficult. In light of suppression of deformation of the hosel member due to the axial force of the screw member, it is preferred that there exists no space between the head external surface and the hosel hole 26 in at least a region above the opening of the head hole 70. In other words, it is preferred that the head 4 is solid between the head external surface and the hosel hole 26 in at least a region above the opening of the head hole 70. More preferably, there exists no space between the head external surface and the hosel hole 26 in the entire region of the hosel hole 26.

The engagement of the screw member 10 with the continuous hole 76 (first engagement) controls relative rotation of the inner member 8 and the hosel member 22 of the head 4. As described above, control of this relative rotation is achieved also by the engagement of the engaging protruding part 50 with the chipped portion 32 (second engagement). This construction leads to dispersion of the stress in connection with the relative rotation into the first engagement and the second engagement, whereby stress concentration is defused. Use of the first engagement and the second engagement in combination certainly prevents the relative rotation.

The head 4 has a control mechanism to control the penetration depth of the screw member 10 with respect to the continuous hole 76. This control mechanism is constructed with step face 78 of the screw member 10, and receiving face 80 that abuts this step face 78. The step face 78 of the screw member 10 is positioned at the boundary of the head part 36 and the body part 38. The presence of the step face 78 results from the external diameter of the head part 36 made larger than the external diameter of the body part 38. The shape of the external head hole 72 corresponds to the shape of this screw member 10. The abutment of the step face 78 and the receiving face 80 controls the penetration depth of the screw member 10. This control mechanism enables rigid screwing of the screw member 10, whereby the screw member 10 becomes less liable to be loosened, thereby inhibiting disengagement of the screw member 10. Thus, this control mechanism can even further ensure the connection of the inner member 8 with the hosel hole 26.

As described above, the chipped portion 32 of the hosel member 22 is engaged with the engaging protruding part 50 of the inner member 8. This engagement leads to positioning such that the engaging hole 52 is continuous with the head hole 70. As shown in FIG. 7, the engaging protruding part 50 is arranged evenly every 90° in the circumferential direction in this embodiment. Therefore, the inner member 8 can be arranged in the circumferential direction in four ways in the state where the engaging protruding part 50 is engaged with the chipped portion 32. Through selecting appropriate two ways among these, the continuous hole 76 can be formed. Moreover, through selecting an appropriate one way, the continuous hole 76 into which the screw member 10 can be screwed is formed. In such a manner, engagement of the chipped portion 32 with the engaging protruding part 50 leads to positioning such that the engaging hole 52 is continuous with the head hole 70. The engagement of the chipped portion 32 with the engaging protruding part 50 can save labor in adjusting the position.

In the aforementioned embodiment, a control mechanism of insertion length for controlling the insertion length S of the inner member 8 with respect to the hose 1 hole 26 is involved. As described above, this control mechanism of insertion length is constructed with engagement of the bottom end 58 of the engaging protruding part 50 with the bottom end 60 of the chipped portion 32 in this embodiment. As other control mechanism of insertion length, for example, a stopper which is provided on the bottom member of the hosel hole 26 and abuts the bottom end face of the inner member 8 may be exemplified.

Such a control mechanism of insertion length still further ensures fixation of the inner member 8 to the hosel member 22. More specifically, the inner member 8 is engaged with the head 4 by the screw member 10, and in turn, engaged with the head 4 via this control mechanism of insertion length. Therefore, fixation of the inner member 8 to the hosel hole 26 can be still more ensured.

As described above, the inner member 8 is stuck with the shaft 6. Therefore, when the inner member 8 is fixed to the head 4, the shaft 6 will be fixed to the head 4. In addition, release of the screw by removing the screw member 10 enables the head 4 and the shaft 6 to be separated. Thus, the shaft 6 can be attached to/detached from the head 4.

As the assembly procedure of the golf club 2, the following Procedure 1 may be illustrated.

[Assembly Procedure 1]

This procedure includes the following steps (1) to (4).

(1) The shaft 6 is press-fitted into the insertion hole 44 of the ferrule 12.

(2) The tip part of the shaft 6 is put into the shaft channel 46 of the inner member 8, and the tip part and the inner member 8 are joined by an adhesive or the like.

(3) The inner member 8 is put into the hosel hole 26.

(4) The screw member 10 is inserted into the head hole 70, and screwing is permitted.

The step (1) is also referred to generally as "ferrule driving". The ferrule driving is a step also carried out in assembly of common golf clubs. The ferrule 12 is fixed at a predetermined position on the shaft 6 in the step (1). This predetermined position is the same as the position on the golf club 2.

After perfecting assembly by the above Procedure 1, the shaft 6 can be readily attached and detached. In other words, the shaft 6 can be attached/detached by tightening and releasing of the screw mechanism with respect to the head 4. When the shaft 6 is sold as a part before being assembled, a member after completing the steps (1) and (2) in the Assembly Procedure 1 may be employed.

Figure 10:
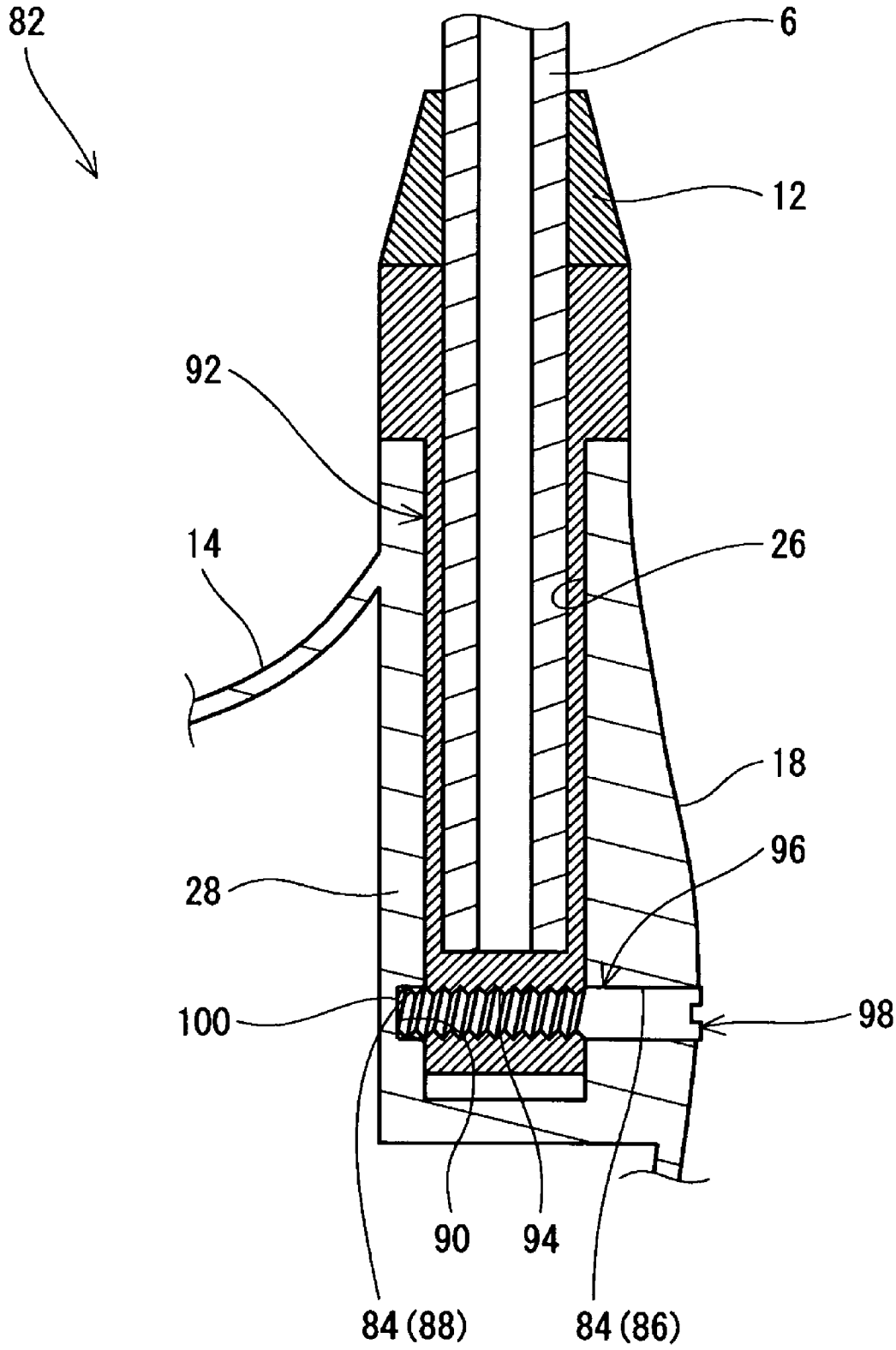
FIG. 10 shows a cross-sectional view of a golf club according to another embodiment.

FIG. 10 shows a cross-sectional view illustrating head 82 according to another embodiment. The head 82 is different from the head 4 described above in construction of the continuous hole and the screw member. The head 82 is constructed similarly to the head 4 except for the continuous hole and the screw member.

As shown in FIG. 10, the head 82 has head hole 84. The head 82 has external head hole 86 provided on more external surface side of the head than the hosel hole 26, and inner head hole 88 provided more inside the head than the hosel hole 26. The external head hole 86 runs from the external surface of the head 82 to the hosel hole 26. The inner head hole 88 runs from the inner peripheral face of the hosel hole 26 but does not reach to the hollow part of the head 82. The inner head hole 88 does not penetrate the hole forming part 28 of the head 82. The inner head hole 88 has a bottom. The inner head hole 88 has bottom face 90. The external head hole 72 and the inner head hole 88 are coaxially arranged. In other words, the central axis of the external head hole 86 is in common with the central axis of the inner head hole 88. The head hole 84 is divided into the external head hole 86 and the inner head hole 88 by the hosel hole 26.

The head hole 84 and the engaging hole 94 of the inner member 92 form single hole that is continuous with one another. Continuous hole 96 is formed by the engaging hole 94 and the head hole 84 continuous therewith. The external head hole 86, the engaging hole 94, and the inner head hole 88 form the continuous hole 96. Screw member 98 is inserted into this continuous hole 96. The screw member 98 is inserted into the external head hole 86, the engaging hole 94 and the inner head hole 88. The continuous hole 96 is open outward. The continuous hole 96 is open to the side member 18 of the head 82. The screw member 98 can be screwed from this opening.

A threaded part is formed on the inner peripheral face of the engaging hole 94. The threaded part of this engaging hole 94 is female threaded. Any threaded part is not formed on the inner peripheral face of the head hole 84. In other words, no threaded part is formed on the inner peripheral face of the external head hole 86, and no threaded part is formed on the inner peripheral face of the inner head hole 88.

The screw member 98 does not have a head part. The external diameter of the screw member 98 is substantially the same along the entire length thereof. The screw member 98 is thread connected with the engaging hole 94. More specifically, the threaded part (female screw) of the engaging hole 94 and the threaded part (male screw) of the screw member 98 are thread connected. The head hole 84 is not thread connected with the screw member 98. More specifically, the external head hole 86 and the screw member 98 are not thread connected, and the inner head hole 88 and the screw member 98 are not thread connected.

Accordingly, at least a part of the continuous hole 96 and the screw member 98 are thread connected. In this embodiment, the engaging hole 94 is thread connected with the screw member 98. This thread connection allows for rigid engagement of the inner member 92 with the screw member 98. Further, the screw member 98 is also engaged with the head hole 84. In other words, the screw member 98 is engaged with the head hole 84 by insertion into the external head hole 86 and the inner head hole 88. Therefore, the inner member 92 and the head 82 are surely engaged by the screw member 98. This engagement prevents removal of the inner member 92 from the hosel hole 26.

The head 82 has a control mechanism to control the penetration depth of the screw member 98 with respect to the continuous hole 96. This control mechanism is constructed with end face 100 of the screw member 98, and bottom face 90 that abuts this end face 100. The end face 100 of the screw member 98 is the end face of the screw member 98 on the side of the penetrating orientation in screwing. The abutment of the bottom face 90 and the end face 100 controls the penetration depth of the screw member 98. This control mechanism enables rigid screwing of the screw member 98, whereby the screw member 98 becomes less liable to be loosened, thereby inhibiting disengagement of the screw member 98. Thus, this control mechanism can even further ensure the connection of the inner member 92 with the hosel hole 26. Moreover, engagement of the chipped portion with the engaging protruding part leads to positioning such that the engaging hole 94 is continued to the head hole 84 also in this head 82.

Figure 11:
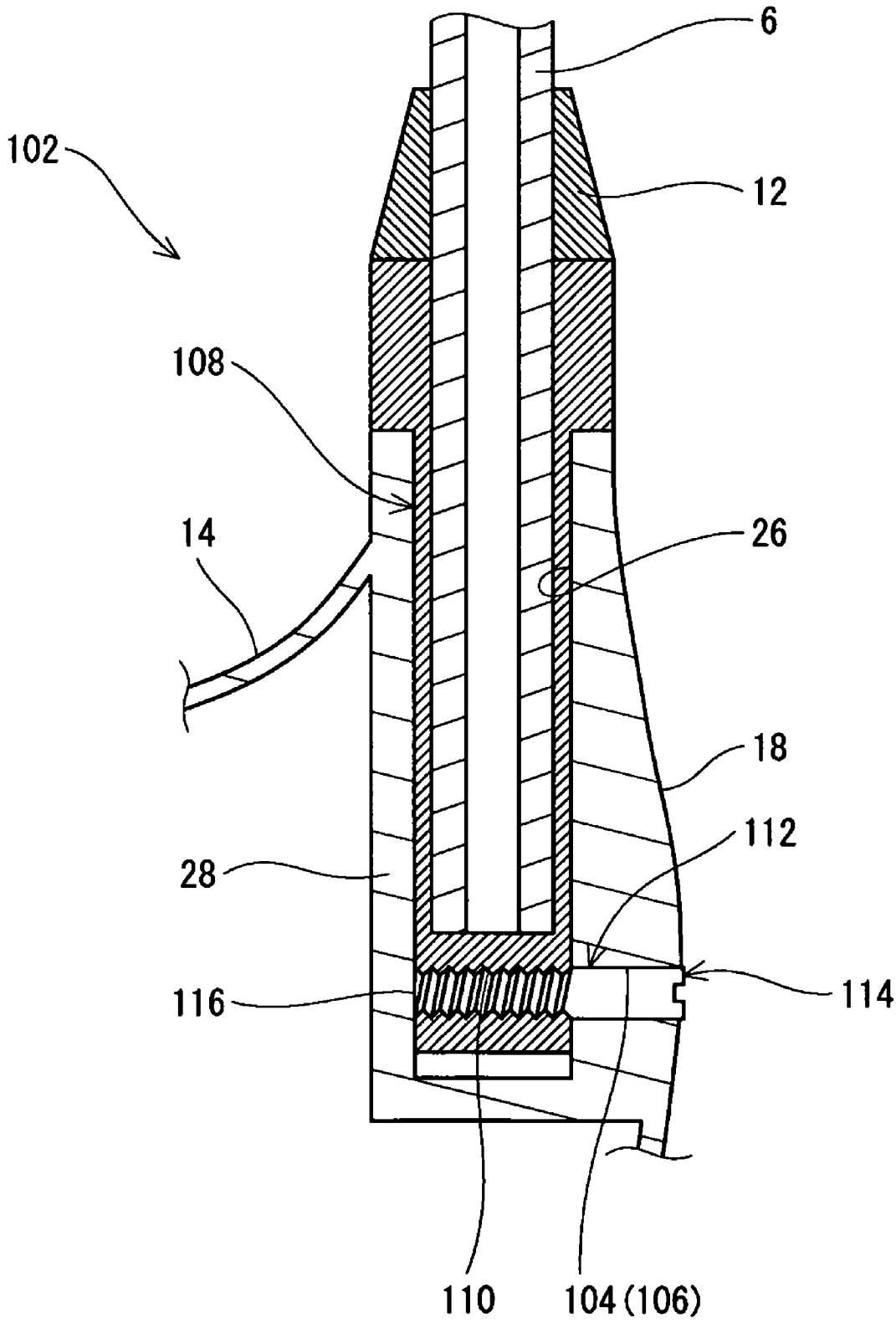
FIG. 11 shows a cross-sectional view of a golf club according to still another embodiment.

FIG. 11 shows a cross-sectional view illustrating head 102 according to another embodiment. The head 102 is different from the head 4 described above in construction of the continuous hole and the screw member. The construction of the head 102 is the same as that of the head 4 except for the continuous hole and the screw member.

As shown in FIG. 11, the head 102 has head hole 104. The head 102 has external head hole 106 provided on more external surface side of the head than the hosel hole 26. The head hole 104 is constructed with the external head hole 106 alone. The head hole 104 does not have an inner head hole provided more inside the head than the hosel hole 26. The head hole 104 is provided only on more external surface side of the head than the hosel hole 26. The external head hole 106 runs from the external surface of the head 102 reaching to the hosel hole 26.

The head hole 104 and the engaging hole 110 of the inner member 108 form single hole that is continuous with one another. Continuous hole 112 is formed by the engaging hole 110 and the head hole 104 continuous therewith. The head hole 104, and the engaging hole 110 form the continuous hole 112. Screw member 114 is inserted into this continuous hole 112. The screw member 114 is inserted into the head hole 104 (external head hole 106) and the engaging hole 110. The continuous hole 112 is open outward. The continuous hole 112 is open to the side member 18 of the head 102. The screw member 114 can be screwed from this opening.

A threaded part is formed on the inner peripheral face of the engaging hole 110. The threaded part of this engaging hole 110 is female threaded. Any threaded part is not formed on the inner peripheral face of the head hole 104.

The screw member 114 does not have a head part. The external diameter of the screw member 114 is substantially the same along the entire length thereof. The screw member 114 is thread connected with the engaging hole 110. More specifically, the threaded part (female screw) of the engaging hole 110 and the threaded part (male screw) of the screw member 114 are thread connected. The head hole 104 is not thread connected with the screw member 114.

Accordingly, at least a part of the continuous hole 112 and the screw member 114 are thread connected. In this embodiment, the engaging hole 110 is thread connected with the screw member 114. This thread connection allows for rigid engagement of the inner member 108 with the screw member 114. Further, the screw member 114 is also engaged with the head hole 104. The screw member 114 is engaged with the head hole 104 by insertion into the head hole 104. Therefore, the inner member 108 and the head 102 are surely engaged by the screw member 114. This engagement prevents removal of the inner member 108 from the hosel hole 26.

The head 102 has a control mechanism to control the penetration depth of the screw member 114 with respect to the continuous hole 112. This control mechanism is constructed with end face 116 of the screw member 114, and the inner peripheral face of the hosel hole 26 that abuts this end face 116. The end face 116 is the end face of the screw member 114 on the side of the penetrating orientation in screwing. The abutment of the inner peripheral face of the hosel hole 26 and the end face 116 controls the penetration depth of the screw member 114. This control mechanism enables rigid screwing of the screw member 114. Therefore, the screw member 114 becomes less liable to be loosened, thereby inhibiting disengagement of the screw member 114. Thus, this control mechanism can even further ensure the connection of the inner member 108 with the hosel hole 26. Moreover, engagement of the chipped portion with the engaging protruding part leads to positioning such that the engaging hole 110 is continued to the head hole 104 also in this head 102.

Figure 12:
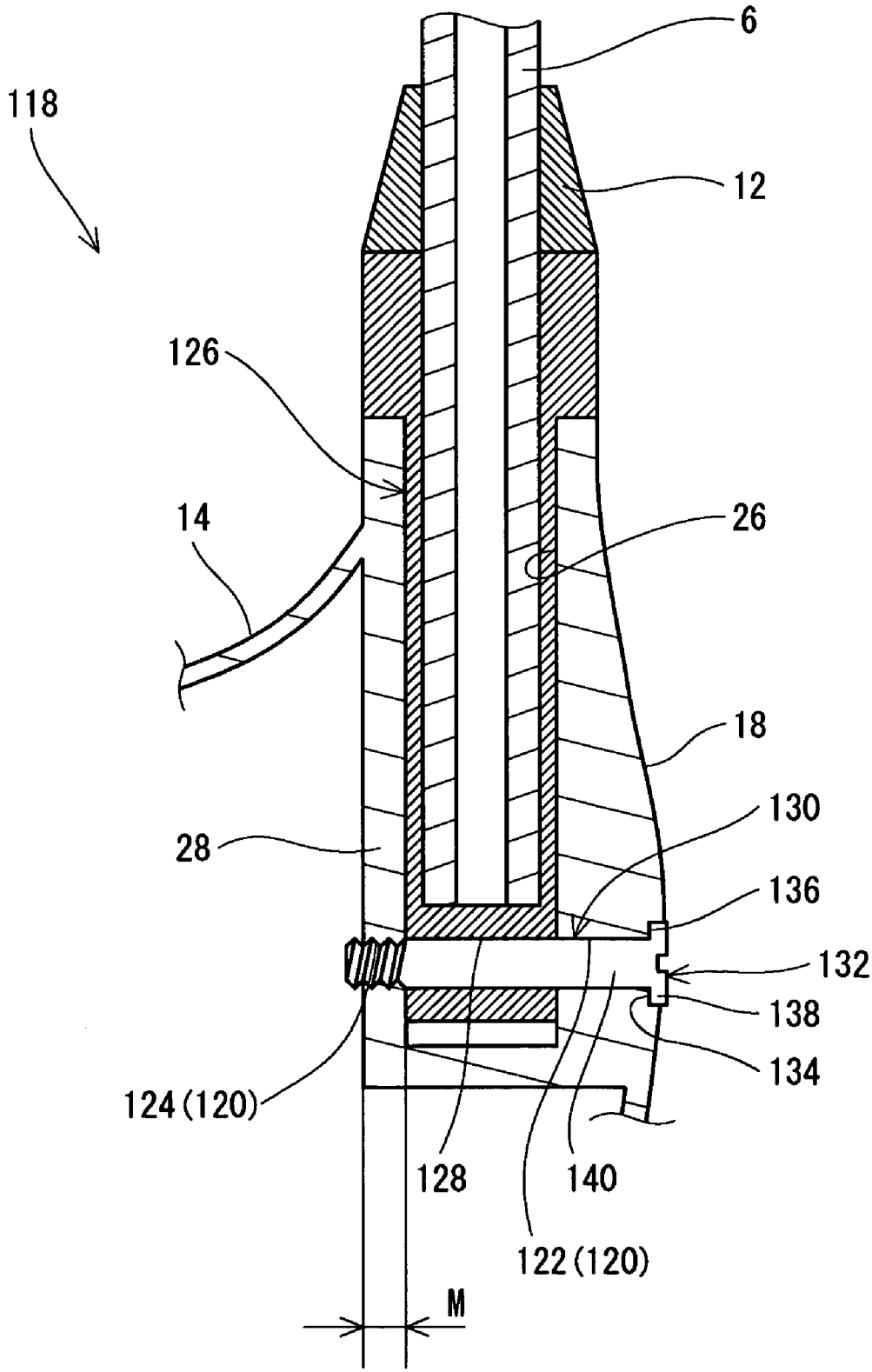
FIG. 12 shows a cross-sectional view of a golf club according to yet another embodiment.

FIG. 12 shows a cross-sectional view illustrating head 118 according to another embodiment. As shown in FIG. 12, the head 118 has head hole 120. The head hole 120 has external head hole 122 provided on more external surface side of the head than the hosel hole 26, and inner head hole 124 provided more inside the head than the hosel hole 26. The external head hole 122 runs from the external surface of the head 118 reaching to the hosel hole 26. The inner head hole 124 runs from the inner peripheral face of the hosel hole 26 reaching to the hollow part of the head 118. The inner head hole 124 penetrates the hole forming part 28 of the head 118. The external head hole 122 and the inner head hole 124 are coaxially arranged. In other words, the central axis of the external head hole 122 is in common with the central axis of the inner head hole 124. The head hole 120 is divided into the external head hole 122 and the inner head hole 124 by the hosel hole 26.

The head hole 120 and the engaging hole 128 of the inner member 126 form single hole that is continuous with one another. Continuous hole 130 is formed by the engaging hole 128 and the head hole 120 continuous therewith. The external head hole 122, the engaging hole 128, and the inner head hole 124 form the continuous hole 130. Screw member 132 is inserted into this continuous hole 130. The screw member 132 is inserted into the external head hole 122, the engaging hole 128 and the inner head hole 124. The continuous hole 130 is open outward. The continuous hole 130 is open to the side member 18 of the head 118. The screw member 132 can be screwed from this opening.

The inner member 126 and the screw member 132 are not thread connected in this embodiment. Any threaded part is not formed on the inner peripheral face of the engaging hole 128. To the contrary, a threaded part is formed on at least a part of the inner peripheral face of the head hole 120. In this embodiment, a threaded part is formed on the inner peripheral face of the inner head hole 124. Any threaded part is not formed on the inner peripheral face of the external head hole 122.

The screw member 132 is thread connected with the inner head hole 124. More specifically, the threaded part (female screw) of the inner head hole 124 and the threaded part (male screw) of the screw member 132 are thread connected. In this embodiment, the head hole 120 and the screw member 132 are thread connected.

Accordingly, at least a part of the continuous hole 130 and the screw member 132 are thread connected. In this embodiment, the inner head hole 124 is thread connected with the screw member 132. This thread connection allows for rigid engagement of the head hole 120 with the screw member 132. Further, the screw member 132 is also engaged with the inner member 126. In other words, the screw member 132 is engaged with the inner member 126 by insertion into the engaging hole 128. Therefore, the inner member 126 and the head 118 are surely engaged by the screw member 132. This engagement prevents removal of the inner member 126 from the hosel hole 26.

The head 118 has a control mechanism to control the penetration depth of the screw member 132 with respect to the continuous hole 130. This control mechanism is constructed with step face 134 of the screw member 132, and receiving face 136 that abuts this step face 134. The screw member 132 has head part 138 and body part 140. The step face 134 of the screw member 132 is positioned at the boundary of the head part 138 and the body part 140. The presence of the step face 134 results from the external diameter of the head part 138 made larger than the external diameter of the body part 140. The shape of the external head hole 122 corresponds to the shape of this screw member 132. The abutment of the step face 134 and the receiving face 136 controls the penetration depth of the screw member 132. This control mechanism enables rigid screwing of the screw member 132. Therefore, the screw member 132 becomes less liable to be loosened, thereby inhibiting disengagement of the screw member 132. This control mechanism can even further ensure the connection of the inner member 126 with the hosel hole 26. Moreover, engagement of the chipped portion with the engaging protruding part leads to positioning such that the engaging hole 128 is continued to the head hole 120 also in this head 118.

Figure 13:
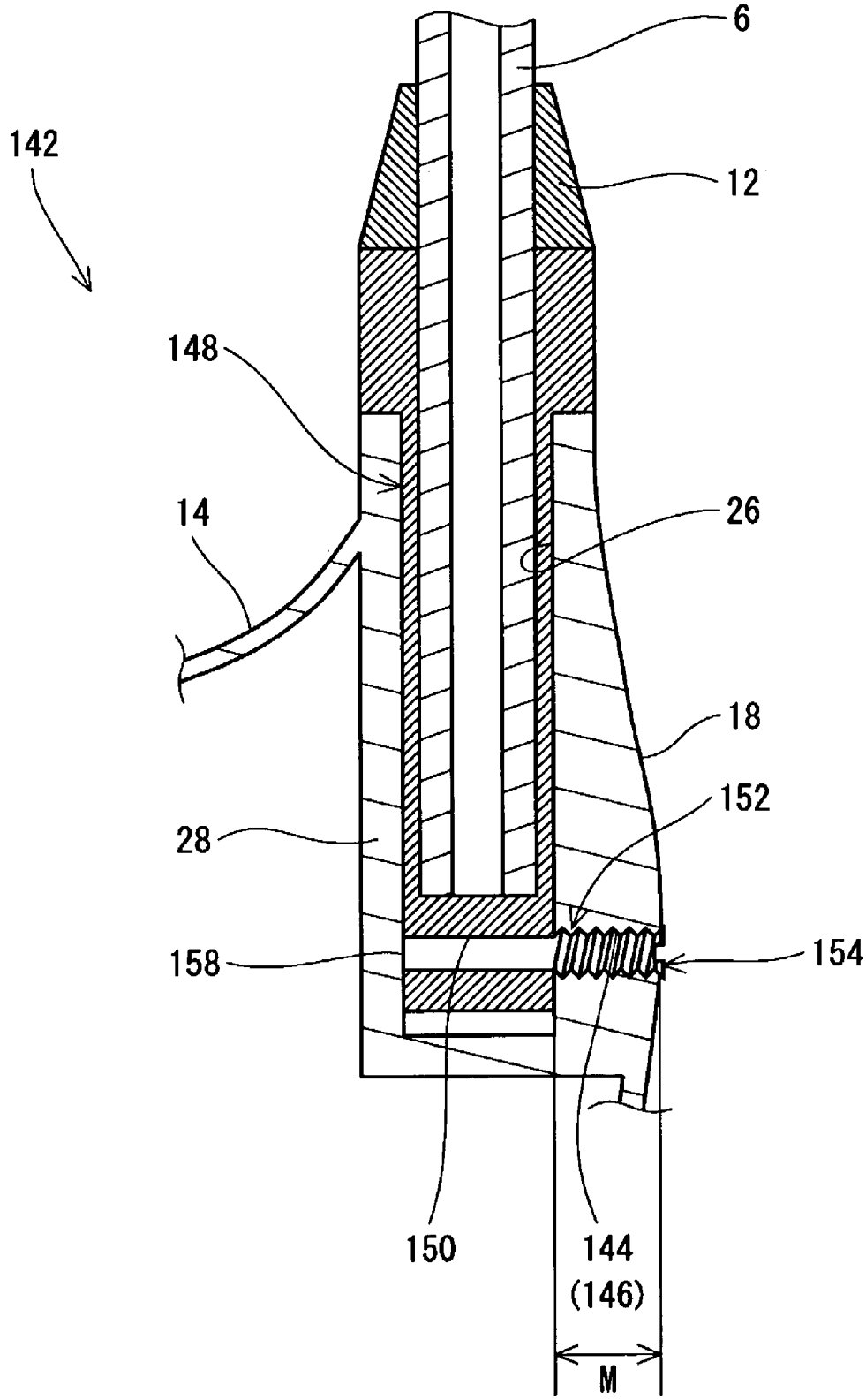
FIG. 13 shows a cross-sectional view of a golf club according to yet another embodiment.

FIG. 13 shows a cross-sectional view illustrating head 142 according to another embodiment. The head 142 is different from the head 4 described above in construction of the continuous hole and the screw member. The construction of the head 142 is the same as that of the head 4 except for the continuous hole and the screw member.

As shown in FIG. 13, the head 142 has head hole 144. The head 142 has external head hole 146 provided on more external surface side of the head than the hosel hole 26. The head hole 144 is constructed with the external head hole 146 alone. The head hole 144 does not have the inner head hole positioned more inside the head than the hosel hole 26. The head hole 144 is provided only on more external surface side of the head than the hosel hole 26. The external head hole 146 runs from the external surface of the head 142 reaching to the hosel hole 26.

The head hole 144 and the engaging hole 150 of the inner member 148 form single hole that is continuous with one another. Continuous hole 152 is formed by the engaging hole 150 and the head hole 144 continuous therewith. The head hole 144 and the engaging hole 150 form the continuous hole 152. Screw member 154 is inserted into this continuous hole 152. The screw member 154 is inserted into the head hole 144 (external head hole 146) and the engaging hole 150. The continuous hole 152 is open outward. The continuous hole 152 is open to the side member 18 of the head 142. The screw member 154 can be screwed from this opening.

Any threaded part is not formed on the inner peripheral face of the engaging hole 150. To the contrary, a threaded part is formed on the inner peripheral face of the head hole 144. This threaded part is female threaded.

The screw member 154 does not have a head part. The screw member 154 is thread connected with the head hole 144. More specifically, the threaded part (female screw) of the head hole 144 and the threaded part (male screw) of the screw member 154 are thread connected. The engaging hole 150 is not thread connected with the screw member 154.

Accordingly, at least a part of the continuous hole 152 and the screw member 154 are thread connected. In this embodiment, the head hole 144 is thread connected with the screw member 154. This thread connection allows for rigid engagement of the head hole 144 with the screw member 154. Further, the screw member 154 is also engaged with the inner member 148. The screw member 154 is engaged with the inner member 148 by insertion of the screw member 154 into the engaging hole 150. Therefore, the inner member 148 and the head 142 are surely connected by the screw member 154. This connection prevents removal of the inner member 148 from the hosel hole 26.

The head 142 has a control mechanism to control the penetration depth of the screw member 154 with respect to the continuous hole 152. This control mechanism is constructed with end face 158 of the screw member 154, and the inner peripheral face of the hosel hole 26 that abuts this end face 158. The end face 158 is the end face of the screw member 154 on the side of the penetrating orientation in screwing. The abutment of the inner peripheral face of the hosel hole 26 and the end face 158 controls the penetration depth of the screw member 154. This control mechanism enables rigid screwing of the screw member 154. Therefore, the screw member 154 becomes less liable to be loosened, thereby inhibiting disengagement of the screw member 154. This control mechanism can even further ensure the connection of the inner member 148 with the hosel hole 26. Moreover, engagement of the chipped portion with the engaging protruding part leads to positioning such that the engaging hole 150 is continued to the head hole 144 also in this head 142.

The material of the head is not limited. Illustrative examples of the material of the head include titanium, titanium alloys, CFRP (carbon fiber reinforced plastic), stainless steel, Maraging steel, magnesium alloys, aluminum alloys, iron and the like. The head may be constituted with multiple materials in combination. The head may include a head main body produced by casting that is joined with a face member produced by forging or pressing.

The structure of the head is not limited. The head may be integrally molded as a whole, or formed by joining multiple members. The method of manufacturing the head is not limited. Illustrative examples of the method of manufacturing the head include casting such as lost wax precision casting, forging and the like. Also, the head hole may be formed concurrently with the molding of the head, or may be formed by mechanical processing or the like after molding the head.

The material of the shaft is not limited. Illustrative examples of the material of the shaft include CFRP (carbon fiber reinforced plastic) and metals. So-called carbon shaft and steel shaft can be suitably used. Additionally, the structure of the shaft is not also limited.

The material of the inner member is not limited. Examples of the material of the inner member include stainless steel, aluminum, aluminum alloys, titanium, titanium alloys, magnesium, magnesium alloys, CFRP (carbon fiber reinforced plastic), resins, and the like. Particularly, in light of enhancement of the strength in the vicinity of the engaging hole, the inner member preferably has a high strength. In these respects, preferable material of the inner member may be stainless steel, titanium, titanium alloys, and the like.

The material of the screw member is not limited. Examples of the material of the screw member include stainless steel, aluminum, aluminum alloys, titanium, titanium alloys, magnesium, magnesium alloys, CFRP (carbon fiber reinforced plastic), resins, and the like. In light of enhancement of durability against hitting, the screw member preferably has a high strength. In these respects, preferable material of the screw member may be stainless steel, titanium, titanium alloys, and the like.

In FIG. 8, what is indicated by a both-oriented arrowhead A is the depth of the shaft channel. In light of enhancement of the adhesion strength between the inner member and the shaft, the depth A is preferably equal to or greater than 20 mm, more preferably equal to or greater than 23 mm, and still more preferably equal to or greater than 28 mm. When the inner member is long, the depth of the hosel hole 26 is liable to be increased, whereby the weight of the hosel member is likely to be increased. In light of suppression of increase in the weight of the hosel member, and inhibition of excessive decrease in the center of gravity distance, or excessive elevation of the position of the center of gravity, the depth A is preferably equal to or less than 40 mm, more preferably equal to or less than 38 mm, and still more preferably equal to or less than 35 mm.

In FIG. 8, what is indicated by a both-oriented arrowhead B is the external diameter of the circumference face part in the inner member. When the external diameter B is excessively small, the internal diameter of the shaft channel cannot be sufficiently secured, whereby the adhesion strength between the shaft and the inner member is liable to be lowered. In this respect, the external diameter B is preferably equal to or greater than 7.0 mm, more preferably equal to or greater than 8.0 mm, and still more preferably equal to or greater than 8.5 mm. When the inner member 8 is large in the thickness, the internal diameter of the hosel hole is also liable to be increased, whereby the weight of the hosel member is likely to be increased. In light of suppression of increase in the weight of the hosel member, and inhibition of excessive decrease in the center of gravity distance, or excessive elevation of the position of the center of gravity, the external diameter B is preferably equal to or less than 12.0 mm, more preferably equal to or less than 11.0 mm, and still more preferably equal to or less than 10.0 mm.

In light of securing the support of the inner member by the hosel hole, it is preferred that the external diameter B of the circumference face part be substantially the same as the pore size a of the hosel hole. Specifically, the external diameter B (mm) and the pore size α (mm) preferably follow the following formula of:

$$[\alpha-0.20]\leqq B\leqq\alpha.$$

In FIG. 8, what is indicated by a both-oriented arrowhead C is the length of the engaging protruding part along the axial direction. In light of suppression of relative rotation of the inner member and the hosel member in hitting, the length C is preferably equal to or greater than 5.0 mm, more preferably equal to or greater than 8.0 mm, and still more preferably equal to or greater than 10.0 mm. When the length C is too great, the length of the inner member and the hosel hole are is liable to increase, whereby the weight of the inner member and the hosel member is likely to be increased. Due to this increase in the weight, the center of gravity distance is likely to be excessively short, or the position of the center of gravity is likely to be excessively high. In light of inhibition of excessive decrease in the center of gravity distance, or excessive elevation of the position of the center of gravity, the length C is preferably equal to or less than 20.0 mm, more preferably equal to or less than 17.0 mm, and still more preferably equal to or less than 15.0 mm.

In FIG. 7 and FIG. 8, what is indicated by a both-oriented arrowhead D is the protrusion length of the engaging protruding part. This protrusion length D is measured in the radial direction. In light of enhancement of the strength of the engaging protruding part, and suppression of relative rotation of the inner member and the hosel member, the length D is preferably equal to or greater than 1.0 mm, more preferably equal to or greater than 1.2 mm, and still more preferably equal to or greater than 1.5 mm. When the weight of the inner member is excessively increased, the position of the center of gravity of the head portion including the inner member is apt to be excessively high or get closer to the heel. In light of suppression of increase in the weight of the inner member, the length D is preferably equal to or less than 3.0 mm, more preferably equal to or less than 2.7 mm, and still more preferably equal to or less than 2.5 mm.

In FIG. 8, what is indicated by a both-oriented arrowhead E is the internal diameter of the shaft channel. In light of prevention of the shaft external diameter from becoming excessively small and enhancement of the strength of the shaft, the internal diameter E is preferably equal to or greater than 7.0 mm, more preferably equal to or greater than 7.5 mm, and still more preferably equal to or greater than 8.0 mm. In light of prevention of the shaft external diameter from becoming excessively small and prevention of the shaft tip part from becoming excessively hard, the internal diameter E is preferably equal to or less than 11.0 mm, more preferably equal to or less than 10.5 mm, and still more preferably equal to or less than 10.0 mm.

In light of enhancement of the adhesion strength between the shaft and the inner member while permitting insertion of the shaft, it is preferred that this internal diameter E (mm) and the shaft external diameter X (mm) of the part inserted into the shaft channel follow the following formula:

$$[E-0.20] \leqq X \leqq E.$$

In FIG. 8, what is indicated by a both-oriented arrowhead F is the maximum diameter of the engaging hole. In light of increase in the thickness of the screw member to enhance the strength of the screw member, the maximum diameter F is preferably equal to or greater than 4 mm, more preferably equal to or greater than 4.5 mm, and most preferably equal to or greater than 5 mm. In light of increase in the wall thickness of the inner member in the vicinity of the engaging hole to enhance the strength of the inner member, the maximum diameter F is preferably equal to or less than 9 mm, more preferably equal to or less than 8 mm, and most preferably equal to or less than 7 mm.

In FIG. 8, what is indicated by a both-oriented arrowhead G is the length of the bottom member 48 of the inner member along the axial direction. In light of increase in the thickness around the engaging hole to enhance the strength of the inner member, the length G is preferably equal to or greater than 6 mm, more preferably equal to or greater than 7 mm, and most preferably equal to or greater than 8 mm. In light of suppression of increase in the weight of the inner member, the length G is preferably equal to or less than 14 mm, more preferably equal to or less than 13 mm, and most preferably equal to or less than 12 mm.

In FIG. 8, what is indicated by a both-oriented arrowhead H is the minimum thickness of the inner member around the engaging hole. In light of increase in the thickness around the engaging hole to enhance the strength of the inner member, the thickness H is preferably equal to or greater than 1 mm, more preferably equal to or greater than 1.5 mm, and most preferably equal to or greater than 2 mm. In light of suppression of increase in the weight of the inner member, the thickness H is preferably equal to or less than 4 mm, more preferably equal to or less than 3.5 mm, and most preferably equal to or, less than 3 mm.

In FIG. 9, what is indicated by a both-oriented arrowhead J is the width of the chipped portion. In light of increase in the width of the engaging protruding part to enhance the strength of the engaging protruding part, the width J is preferably equal to or greater than 1.0 mm, more preferably equal to or greater than 1.5 mm, and still more preferably equal to or greater than 2.0 mm. When the width J is too great, the strength of the hosel member at a part where the chipped portion is provided is liable to be reduced. In light of enhancement of the strength of the hosel member, the width J is preferably equal to or less than 4.0 mm, more preferably equal to or less than 3.5 mm, and still more preferably equal to or less than 3.0 mm.

In light of preventing the tip part of the shaft from becoming excessively thin to thereby enhancing the strength of the shaft, the external diameter X (mm) of the shaft is preferably equal to or greater than 6.0 mm, more preferably equal to or greater than 6.5 mm, and still more preferably equal to or greater than 7.0 mm. In light of preventing the tip part of the shaft from becoming excessively thick to thereby avoiding excessive hardening of the tip part of the shaft, the external diameter X (mm) of the shaft is preferably equal to or less than 11.0 mm, more preferably equal to or less than 10.5 mm, and still more preferably equal to or less than 10.0 mm.

In FIG. 5 and the like, what is indicated by a both-oriented arrowhead M is the length of a part where the continuous hole and the screw member are thread connected. This length M is measured in the axial direction of the screw member. In light of enhancement of the fastening force of the thread connection, the length M is preferably equal to or greater than 2.0 mm, more preferably equal to or greater than 5.0 mm, and still more preferably equal to or greater than 8.0 mm. According to the construction in which the length M becomes excessively great, the position of the center of gravity of the head portion including the screw member is liable to get excessively close to the heel. In light of prevention of the position of the center of gravity from getting excessively close to the heel, the length M is preferably equal to or less than 11.0 mm, more preferably equal to or less than 10.0 mm, and still more preferably equal to or less than 9.0 mm.

In FIG. 5, what is indicated by a both-oriented arrowhead K is the insertion length of the shaft in the shaft channel. In light of enhancement of the sticking force of the inner member with the shaft, the insertion length K is preferably equal to or greater than 25 mm, more preferably equal to or greater than 30 mm, and most preferably equal to or greater than 35 mm. In light of prevention of the inner member from becoming excessively heavy, the insertion length K is preferably equal to or less than 50 mm, more preferably equal to or less than 45 mm, and most preferably equal to or less than 43 mm.

In FIG. 5, what is indicated by a both-oriented arrowhead P is the shaft length of the part that was stuck to the shaft channel and is present inside the hosel hole. Support of the shaft channel and the shaft by the hosel hole renders the shaft less likely to be deformed in the shaft channel, whereby the sticking of the shaft channel with the shaft becomes apt to be kept. In this respect, the length P is preferably equal to or greater than 25 mm, more preferably equal to or greater than 30 mm, and most preferably equal to or greater than 35 mm. In light of preventing the hosel member and the inner member from becoming excessively heavy, the length P is preferably equal to or less than 50 mm, more preferably equal to or less than 45 mm, and most preferably equal to or less than 43 mm.

In a part where the continuous hole and the screw member are not thread connected, gap S1 between the continuous hole and the screw member is preferably as small as possible. As the gap S1 is smaller, the engagement of the inner member with the head by the screw member is still further ensured. In this respect, the gap S1 is preferably 0.0 mm or greater and 0.1 mm or less in a part where the continuous hole and the screw member are not thread connected. This gap S1 is measured in the radial direction of the screw member.

As described in the foregoing, the golf club according to the present invention can realize a golf club in which a head and a shaft can be freely attached/detached with a simple structure. The head hole and the chipped portion can be easily produced as long as the head has a common hosel. For example, the head hole and the chipped portion can be formed by subjecting a head having a common hosel to cutting processing. The present invention is applicable to the heads having a general structure, and is very versatile.

EXAMPLES

Hereinafter, advantages of the present invention will be further clarified by way of Examples, however, the present invention should not be construed as being limited based on the description of the Examples.

In a similar manner to the golf club 2 described above, a head, a shaft, an inner member, a screw member and a ferrule were produced. The structure and shape of these were the same as those of the aforementioned golf club 2. The head was integrally molded by lost wax precision casting. The material of the head was Ti-6Al-4V. The head had a weight of 170 g. The material of the inner member was a stainless alloy. The inner member had a weight of 6.3 g. The material of the screw member was a stainless alloy. The screw member had a weight of 2.0 g. These were assembled according to the procedure described above to obtain the golf club shown in FIG. 1. As an adhesive for adhering the shaft and the inner member, "Esplen" manufactured by Tohritu Kasei Kohgyo Co., Ltd. was used. In this Example, the depth A was 30.0 mm; the external diameter B was 9.0 mm; the length C was 10.0 mm; the length D was 2.0 mm; the internal diameter E was 8.5 mm; the maximum diameter F was 6.0 mm; the length G was 10.0 mm; the thickness H was 2.0 mm; the width J was 2.5 mm; the width of the engaging protruding part was also 2.5 mm; the length M was 9.0 mm; the length K was 30.0 mm; and the length P was 30.0 mm. The external diameter X of the shaft tip was 8.4 mm, and the insertion length S of the inner member was 40.0 mm. When balls were hit with this golf club, sticking of the head with the shaft was kept.

The description hereinabove is merely for an illustrative example, and various modifications can be made in the scope not to depart from the principles of the present invention.

The present invention can be applied to any of golf clubs including wood type golf clubs, iron type golf clubs and the like.

What is claimed is:

1. A golf club comprising a shaft, a head, an inner member and a screw member, wherein the inner member has a shaft channel provided so as to open on the top end side, and an engaging hole extending along an axis that is orthogonal to the axis of the shaft channel;

the head has a hosel member having a hosel hole, and a separate head hole that extends from the head external surface inward;

at least a part of the inner member is inserted into the hosel hole;

the shaft and the shaft channel are fitted together by adhesion and/or fitting;

a continuous hole is formed by alignment of the engaging hole continuously with the head hole, and the screw member is inserted into the engaging hole and the head hole through the continuous hole; and the screw member is secured by a threaded arrangement with the engaging hole and/or the head hole, wherein the hosel member has a chipped portion including at least one notch that (1) extends entirely through a radial thickness of an upper end of the hosel member and (2) opens through a top end face of the hosel member, the inner member has at least one engaging protruding part that engages and mates with the at least one notch of the chipped portion, and engagement and mating of the at least one notch of the chipped portion with the at least one engaging protruding part effects (1) circumferential positioning and (2) the extent of insertion of the inner member with respect to the hosel member such that the engaging hole is continuous with the head hole, whereby the shaft and the head can be readily attached and detached.

2. The golf club according to claim 1, wherein the engaging hole and the screw member are secured by a threaded arrangement.

3. The golf club according to claim 1, wherein a control mechanism is provided which controls the penetration depth of the screw member with respect to the continuous hole.

4. The golf club according to claim 1, wherein a bottom end of the engaging protruding part is engaged with a bottom end of the chipped portion.

5. The golf club according to claim 1, wherein a bottom portion of the hosel hole does not abut a bottom end face of the inner member.

6. The golf club according to claim 1, wherein the engaging hole passes through the inner member.

7. The golf club according to claim 1, wherein the continuous hole is open to a side portion of the head.

8. The golf club according to claim 1, wherein the head hole includes an external portion extending outward from the hosel hole to the external surface and an internal portion extending inward from the hosel hole.

9. The golf club according to claim 8, wherein the screw member is inserted into the external portion of the head hole, the engaging hole and the internal portion of the head hole.

10. The golf club according to claim 1, wherein the head hole is divided by the hosel hole into an external portion extending outward to the external surface and an internal portion extending inward from the hosel hole.

11. The golf club according to claim 10, wherein the screw member is inserted into the external portion of the head hole, the engaging hole and the internal portion of the head hole.

12. The golf club according to claim 1, wherein the head hole has an inner peripheral face having at least a portion thereof threaded to engage with the inserted screw member.

* * * * *